United States Patent [19]

Hoyt

[11] 4,245,430

[45] Jan. 20, 1981

[54] VOICE RESPONSIVE TOY

[76] Inventor: Steven D. Hoyt, Rte. 3, Box 44, Lake Geneva, Wis. 53147

[21] Appl. No.: 57,738

[22] Filed: Jul. 16, 1979

[51] Int. Cl.[3] ..... A63H 11/00; A63H 33/26; B60V 1/00; B64C 13/18

[52] U.S. Cl. ..... 46/266; 46/251; 46/228; 46/256; 46/264; 181/125; 318/587

[58] Field of Search ..... 181/125; 367/127; 46/266, 264, 265, 256, 251, 228; 318/587, 580

[56] References Cited

U.S. PATENT DOCUMENTS

| | | | |
|---|---|---|---|
| 2,930,025 | 3/1960 | Zappacosta | 181/125 |
| 2,991,741 | 7/1961 | Chapin | 181/125 |
| 3,130,803 | 4/1964 | Wiggins | 46/256 |
| 3,222,634 | 12/1965 | Foster | 181/125 |
| 3,475,721 | 10/1969 | Cappel, Jr. | 367/127 |
| 3,563,327 | 2/1971 | Mier | 318/587 |
| 3,849,931 | 11/1974 | Gulley, Jr. | 46/256 |
| 3,856,104 | 12/1974 | Ohba | 318/587 |
| 4,027,210 | 5/1977 | Weber | 318/587 |
| 4,109,186 | 8/1978 | Farque | 318/587 |
| 4,119,900 | 10/1978 | Kremnitz | 318/587 |

*Primary Examiner*—Robert Peshock
*Assistant Examiner*—Michael J. Foycik, Jr.
*Attorney, Agent, or Firm*—Leo J. Aubel

[57] ABSTRACT

A sound responsive toy which seeks an emitted sound such as a child's voice, the toy includes control circuitry for activating an associated drive to turn and/or guide the toy toward the child's voice.

9 Claims, 8 Drawing Figures

VOICE RESPONSIVE TOY

BACKGROUND OF INVENTION

Applicant is aware of various phase difference or phase detection circuits such as for example, direction finders, certain types of tracking radar, FM-AM phase detectors, recording and playback head aligning tape machines, standard phase lock loops, and phase time detection. However, none of the prior art, of which applicant is aware, provides a voice responsive motive toy, robot or similar device. None of the prior art, of which applicant is aware, is a type of device in which an audio sound receiving device moves toward and aligns itself with an audio source.

SUMMARY OF INVENTION

The inventive toy includes a circuit comprising a voice responsive sound incidence detector which senses the incidence angle of a sound wave. The circuit controls the associated motor means to move, rotate and/or drive the toy toward the audio source.

The foregoing features and advantages of the present invention will be apparent from the following more particular description of the invention. The accompanying drawings listed hereinbelow are useful in explaining the invention wherein:

DESCRIPTION OF THE INVENTION

Figure 1:
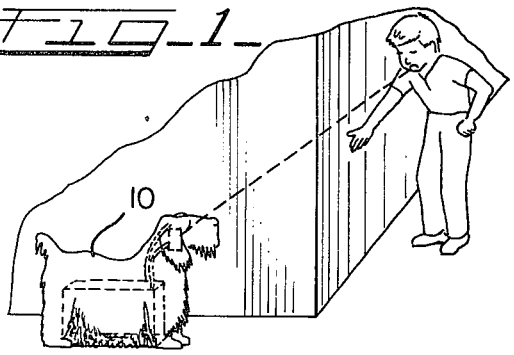
FIG. 1 is a pictorial view depicting the operation of the inventive toy.

FIG. 1 shows an embodiment of the inventive toy 10 which is a motorized, battery propelled toy, and which determines and changes its direction of travel according to the angle of audio sound incidence. The toy will thus "home in" or "move toward" a voice source. The toy 10 includes electronic control circuitry to cause the toy to move and turn, as will be described.

Figure 2:
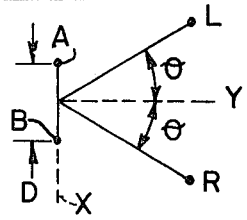
FIG. 2 is a line diagram indicating the mathematical relationship of a source to the microphones mounted on the inventive device.

The circuitry of the invention comprises a sound incidence detector which senses the incidence angle of a sound wave. FIG. 2 illustrates a principle of sound incidence perception by means of triangulation with two microphones. In a basic configuration, the circuitry comprises two microphones, two channels of high gain electronic amplification, and a phase detector.

A longitudinal wave with a plane wave front generated at point L (left) will reach microphone A at a given time and will reach microphone B delayed in time relative to time the wave reaches microphone A. Conversely, a sound wave generated at point R (right) will reach microphone A delayed in time relative to microphone B.

The electrical outputs of both microphones are essentially identical, except for a time displacement relative to the incidence angle of the sound wave which can be calculated by the formula:

$$Td=(D \sin \theta/C)$$

where

Td—Time displacement in seconds

D—Distance between microphones in meters D should be as large as possible, but in no case greater than one-half of the shortest wavelength to be measured.

$\theta$—Angle of incidence of the sound wave

C—Speed of sound in meters/seconds

Note that a simple, omni-directional two-microphone system as indicated in FIG. 2 does not differentiate between a sound source on one side of line X and it's complementary angle on the other side of line X.

Figure 3:
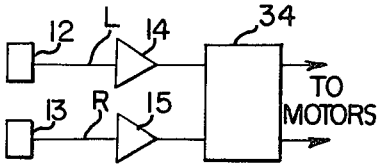
FIG. 3 is a block diagram showing the basic application of the inventive device.

Refer to FIG. 3 which shows a block diagram of a simplified circuit in accordance with the concept of FIG. 2. Two spaced microphones 12 and 13 provide outputs which are amplified by respective amplifiers 14 and 15. Amplifiers 14 and 15, each have sufficient gain to be driven above a selected clipping level by a nominal microphone output, and accordingly the amplifiers operate as sine-to-square wave converters. The gains of the two amplifiers 14 and 15 are closely matched, such that the outputs will be pulses whose time displacement relationship is proportional to the sound incidence angle. The foregoing provides data signals on respective L (left) and R (right) channels suitable for digital processing by an associated integrated circuitry chip (IC) 34 and subsequently activating the toy 10.

Figure 4:
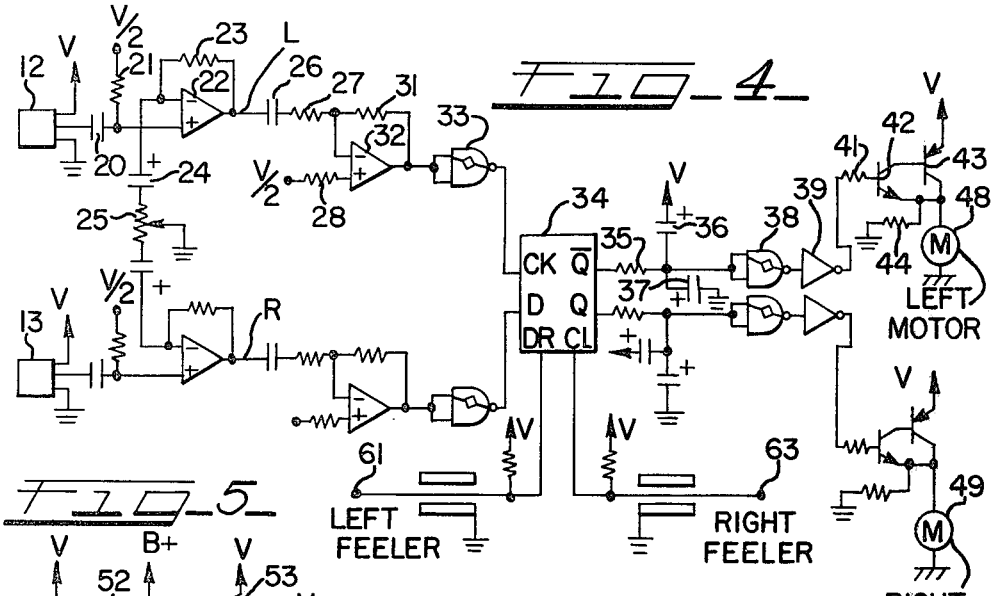
FIG. 4 is a schematic diagram of the circuitry used in the inventive device.

Refer now to FIG. 4 which is a schematic diagram 11 of the electronic circuitry of the invention. Electret microphones 12 and 13 independently receive the sound input from the source (see FIG. 1). The sound impinges on the two microphones 12 and 13 in the manner depicted in FIG. 2 with the time relation of the signals received by the two microphones 12 and 13 being dependent on the angle of sound incidence.

In FIG. 4, the circuitry for data channel or line R is essentially identical to the circuitry for data channel or line L hence the description of data channel L applies also to data channel R.

Figure 5:
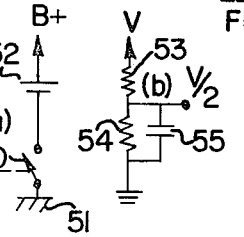
FIGS. 5(*a*) and 5(*b*) indicate the power supply for the circuit of FIG. 4.

The circuitry of FIG. 4 includes a balancing resistor 25 to assure that the two channels L and R amplify the signal inputs to each of microphones 12 and 13 to a same level. Capacitor 20 couples the analog output from microphone 12 to an operational amplifier 22. Refer now briefly to FIGS. 5(*a*) and 5(*b*) which show the power supply circuit for the circuit of FIG. 1. The junction of voltage divider resistors 53 and 54 and capacitor 55 connected in parallel to resistor 54 is connected through terminal V/2 to operate the operational amplifier 22 at half the voltage of the circuit power supply V provided by battery 47. Battery 52 is the power supply for the motors 48 and 49.

Referring again to FIG. 4, resistor 21 is a voltage dropping resistor for operational amplifier 22. Resistor 23, capacitor 24 and variable resistor 25 set the gain and frequency response of the amplifier 22. Likewise, capacitor 26 and resistors 27 and 31 set the gain of operational amplifier 32. Resistor 28 serves the same function as resistor 21.

The purpose of utilizing two amplifiers 22 and 32 is to provide a large amount of gain for the audio input signal. The bandwidth of the amplifiers is chosen to be most sensitive to the fundamental frequency range of human speech; that is from 150–600 Herts. This limited bandwidth rejects unwanted sounds, and permits the microphones 12 and 13 to be mounted with a greater spacing therebetween, since short wavelength sound have been eliminated. The positioning of the microphones 12 and 13 to have a large spacing therebetween provides more accurate sound incidence perception.

A Schmitt trigger 33 squares the output from amplifier 32 to provide a clean symmetrical positive-going square pulse to integrated circuit (IC) chip 34 of suitable known type. The outputs from Schmitt trigger 33 are strictly digital; that is, the outputs may be considered as 1's or 0's.

Figure 8:
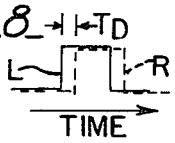

The IC chip 34 will process the signals on each of the channels L and R representative of the audio input signals to microphones 12 and 13. The input signal to one or the other of microphones 12 and 13 will lead in time phase and accordingly provide a positive signal to IC chip 34, leading in time relative to the other signal as indicated in FIG. 8.

Thus, the two digital data signals on channels L and R are processed by the IC chip 34 which is edge triggered and functions as a phase detector. In the case when the pulse on data channel L leads the pulse on data line R, the clock (Ck) terminal, as indicated on the block representative of IC chip 34, will make a low to high transition while terminal D is still low. This sequence cause terminal Q to be low and terminal $\overline{Q}$ to be high. In this case when the pulse on data line R leads the pulse on data line L, the clock (Ck) will make a low to high transition while D is high. This sequence causes terminal Q to be high and terminal $\overline{Q}$ to be low. When the pulse on L and R channels are in time phase, the two outputs of the IC chip 34 are equal. Accordingly, the output of IC chip 34 reflects that phase relationship, or rather time delay differential Td, see FIG. 8, and actuates the respective motors 48 and 49. It is important that the signal inputs on the two channels coupling to IC chip 34 be equal, such that the difference between the signals is the time relationship between the two signals rather than amplitude or frequency response differential. While IC chip 34 is sensitive only to a time-phase relationship, an amplitude mismatch might in effect, provide an undesired time difference phase relationship.

Resistor 35 and capacitors 36 and 37 act somewhat as an integrator or damper to tend to smooth out the output from IC chip 34 and thus the action of the motors. The smoothed output from IC chip 34 is coupled through a Schmitt trigger 38, inverter 39, and resistor 41 to a power amplifier consisting of transistors 42 and 43. Resistor 41 limits the current to the base of transistor 42. Resistor 44 provides isolation between the control circuitry ground and the motor circuitry ground. Resistors 41 and 44 also balance the voltage drop across transistors 42 and 43.

Figure 7:
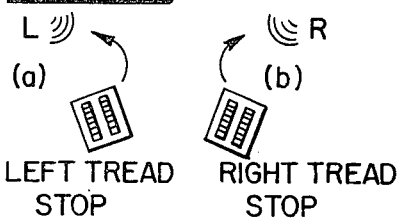
FIGS. 7(*a*) and 7(*b*) depict the turning of the inventive device in response to an indicated sound source; and, FIG. 8 is a sketch indicating the time phase displacement concept of the invention.

The IC chip 34 thus selectively actuates the outputs of the motors 48 and 49 through power transistors. In the embodiment shown, each motor 48 and 49 interfaced with suitable reduction mechanism, to two continuous or caterpillar type tank treads, see FIG. 7. When both motors are running, the toy 10 moves straight forward. Slowing or stopping one of the motors causes the toy to travel in an arc, see FIGS. 7(*a*) and 7(*b*). In FIG. 7(*a*), a left sound source cause the toy 10 to turn left by stopping the left motor. In FIG. 7(*b*), a right sound source cause the toy 10 to turn to the right by stopping the right motor.

Obstacles may physically prevent the toy 10 from reaching the sound source. Since the fundamental frequency range of human speech falls in the 150–600 Hertz band, the toy 10 may "home-in" on a sound source generated in another room even though the sound source may not be in the line-of-sight of the microphones. This phenomena is due to the propagation characteristics of sound in this frequency range, and also due to the fact that most wall materials provide adequate attenuation of these frequencies. In other words, human speech travels from room to room via doorways.

In the event that furniture, door mouldings, etc. prevent to toy 10 from reaching the sound source, "feelers" or microswitches of any suitable known type can be fitted to cause toy 10 to turn and dodge objects by stopping the appropriate motor. Note feelers 61 and 63 in FIG. 4. If the left feeler 61 is actuated, the IC chip 34 will override the signal to the audio response circuit causing the right motor 49 to stop which in turn causes the drive mechanism to turn to avoid object. In other words, triggering the left trigger will cause the mechanism to turn right to avoid the object; and conversely, actuating the right feelers 63 will cause the toy 10 to turn left. Inverter 39 is included in this circuit so that if both feelers are actuated such as by toy 10 hitting a wall, both motors 48 and 49 stop.

Figure 6:
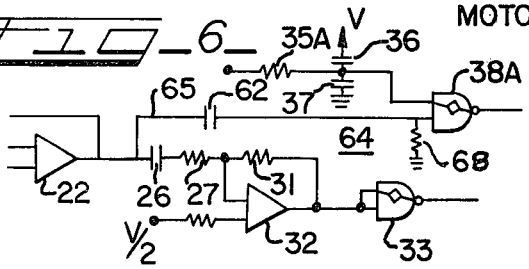
FIG. 6 shows a modification and addition to the circuit of FIG. 4.

When it is desired to have the toy 10 continue going on straight line, upon the absence of human voice, the motor and drive mechanism noise provide this directionality. However, the motors and associated drive mechanisms generate noise which can limit the sensitivity of incidence detection by effectively masking the sound source signal. Also ambient noise and echos, may cause erroneous sound incidence signal. If this is a factor, an electronic noise gate with a suitable threshold of sensitivity can be added to the circuitry. Unless an adequate sound level is present, the noise gate can be connected to cause the toy 10 to move straight forward, or to stop entirely and await a sound command. FIG. 6 shows a noise gate 64 utilizing some of the same components used in FIG. 4. In addition to the structure of FIG. 4, a lead 65 connects through capacitor 62 from the output of amplifier 22 directly to one of the inputs of Schmitt trigger 38, and across resistor 68 which provides a voltage pull down function. A similar circuit would be provided for the R channel.

A doll or manikin may be fitted with the control circuit of FIG. 4 and a reversible drive motor utilized instead of two motors. The motor is driven to rotate the doll's head in one or the other direction toward a sound source to create the illusion that the doll is listening to the speaker. In such device, the noise gate is of particular interest since, it is desirable to have the motors run only periodically and for a short time span. The motor action is only to provide for turning the doll's head to a new direction and it is not necessary to continuously move in response to a sound. The doll need only be induced to seek a sound, and then lock in to the sound and stop. The battery drain in such toy is obviously very low, since unless the motor is actuated, the doll can be in standby mode for many hours without having to shut the motors off manually. The only difference in the electronic circuitry for the doll is the switching arrangement, which closes one set of contacts to actuate the motor one direction, and to close another set of contacts to actuate the motor in the other direction. A limit stop is provided to keep the doll's head from rotating 360°. The eyes of the doll are actuated in the same manner to be responsive to the direction of the speaker voice. The noise gate for the doll stops the motor when there is no sound.

One of the features of the toy is that the battery drain in a non-operating condition is very low. This is due to the fact that the motors 48 and 49 are effectively disconnected when the toy 10 is not running. The battery supply at this point is only powering the electronic circuitry in a standby mode and the battery drain is less then 2 ma. In this mode, the battery will last for hundreds of hours.

As shown in FIG. 5, battery 47 provides the power supply to the electronic circuitry and battery 52 provides the power to the motors 48 and 49 when ganged switch 50 is manually closed. The isolation between the motor ground circuit and the control circuit ground indicated by respective grounds 51 and 56 keeps noise out of amplifying portions of the control circuitry.

While the invention has been particularly shown and described with reference to a preferred embodiment thereof, it will be understood by those skilled in the art, that various changes in form and details may be made therein without departing from the spirit and scope of the invention.

I claim:

1. A toy, comprising in combination, solid surface contacting means, motive means including a power source for actuating said contacting means and moving said toy, an electronic circuit including audio sound responsive means, said electronic circuit including at least two positionally spaced microphones for providing a signal in response to incident sound, a signal processing channel connected to each of said microphones, said channels converting the signal from the respective microphones into pulses, and means for combining the output of said channels and providing an output dependent on the time delay between the pulses on said channels, and means for activating said motive means dependent on said time delay.

2. A toy as in claim 1 wherein said motive means comprises a pair of motors, each of said motors connected to be started and stopped in response to the signals on said channels.

3. A toy as in claim 1 further including at least two feeler means for physically sensing an object, said feeler means electronically connected to said channels for overriding said audio sound and activating the motor associated therewith to tend to avoid the object being sensed by the feeler.

4. A toy as in claim 3 further including means for deactivating said motors when both feeler means sense and contact an object.

5. A toy as in claim 1 further including noise gates for sensing an audio sound above the level of said noise to cause the motors to selectively start and stop in the absence of the audio sound.

6. A toy as in claim 1 wherein the channels include a signal balancing means to assure the signal levels from the two microphones are essentially of the same amplitude to thereby provide an accurate time delay relation between the two signals.

7. A toy as in claim 1 wherein the microphones are omni-directional microphones positioned a selected distance apart.

8. A toy as in claim 1 wherein the ground reference for the electronic circuit is separated from the ground reference for the motor circuit to minimize the effects of noise.

9. A toy as in claim 1, wherein said toy is a doll having a stationary body, and said contacting means comprising a movable member mounted on said body for movement relative thereto.

* * * * *